United States Patent [19]

Fett

[11] Patent Number: 4,885,831

[45] Date of Patent: Dec. 12, 1989

[54] METHOD FOR FORMING A CONTOUR HARDENED GEAR

[75] Inventor: Gregory A. Fett, Ft. Wayne, Ind.

[73] Assignee: Dana Corporation, Toledo, Ohio

[21] Appl. No.: 249,382

[22] Filed: Sep. 26, 1988

[51] Int. Cl.[4] ..... B21K 53/28; C21D 1/06

[52] U.S. Cl. ..... 29/159.2; 148/147

[58] Field of Search ..... 29/159.2; 148/147, 145, 148/146

[56] References Cited

U.S. PATENT DOCUMENTS

| | | | |
|---|---|---|---|
| 1,415,261 | 5/1922 | Nixon et al. | 148/14 |
| 2,167,798 | 8/1939 | Denneen et al. | 219/10.41 |
| 2,364,623 | 12/1944 | Denneen et al. | 219/10.59 |
| 2,390,559 | 12/1945 | Sherman | 219/10.59 |
| 2,428,303 | 9/1947 | Wood | 219/10.59 |
| 2,524,044 | 10/1950 | Denneen et al. | 266/126 |
| 2,564,906 | 8/1951 | Kincaid et al. | 148/146 |
| 2,590,546 | 3/1952 | Kincaid et al. | 148/146 |
| 3,466,023 | 9/1969 | Cunningham et al. | 266/126 |
| 3,515,601 | 6/1970 | Sansom | 148/147 |
| 3,652,346 | 3/1972 | Tomita et al. | 148/154 |
| 4,026,732 | 5/1977 | Dammel et al. | 148/154 |
| 4,123,642 | 10/1978 | Dammel et al. | 219/10.59 |
| 4,154,628 | 5/1979 | Dudek et al. | 148/16.5 |
| 4,251,704 | 2/1981 | Masie et al. | 219/10.59 |
| 4,637,844 | 1/1987 | Pfaffmann | 148/144 |
| 4,639,279 | 1/1987 | Chatterjee | 148/147 |
| 4,675,488 | 6/1987 | Mocha et al. | 148/147 |
| 4,761,867 | 8/1988 | Vollmer et al. | 29/159.2 |

*Primary Examiner*—P. W. Echols
*Assistant Examiner*—K. Jordan
*Attorney, Agent, or Firm*—MacMillan, Sobanski & Todd

[57] ABSTRACT

Initially, an uncut gear blank is softened by a heat treatment process to provide a relatively soft level of hardness throughout. Then, the softened gear blank is machined so as to form a plurality of teeth about the circumference thereof. The relatively soft machined gear is next subjected to a prehardening process, wherein the surfaces of the teeth and the outer region of the core are hardened to a predetermined intermediate level of hardness. Finally, the prehardened gear is subjected to a contour hardening process such that the surfaces of the gear teeth are further significantly hardened. The outer region of the core of the gear remains at the intermediate hardness level, while the inner region of the core remains at the relatively soft level.

10 Claims, 1 Drawing Sheet

METHOD FOR FORMING A CONTOUR HARDENED GEAR

BACKGROUND OF THE INVENTION

The present invention relates in general to processes for manufacturing gears and in particular to an improved method for forming a contour hardened gear.

In the field of gear manufacturing processes, it is known to subject gears to various metal treatment processes in order to harden the contour thereof. Such a contour hardened gear is generally characterized by a relatively thin outer layer or case which is significantly harder than the inner region or core of the gear. This thin hardened layer follows the contour of the teeth of the gear, rather than penetrating deeply therein.

The hardened outer surfaces of contour hardened gears are desirable because they are capable of sustaining relatively high contact forces applied to the faces of the teeth during use. Also, such gears can withstand relatively high bending forces experienced at the roots of the teeth. As a result, contour hardened gears are much less susceptible to premature failure resulting from fatigue. The relatively softer cores of such gears provide a measure of resiliency to absorb the shocks of these high impact forces, and further provide favorable residual compressive stress on the surfaces of the teeth.

Although the core of a contour hardened gear is somewhat softer than the hardened exterior case thereof, such core must also be hardened to a certain extent in order to support the contact and bending loads applied to the teeth. The amount of such hardening is dependent upon the intended use for the gear. Without sufficient hardening of the core of the gear, crushing and spalling may occur on the faces of the teeth, and fracturing may occur in the roots thereof.

In the past, contour hardened gears have been formed by initially prehardening an uncut gear blank (i.e., a metal annulus having no teeth formed therein) to a predetermined level of hardness determined by the desired strength of the core. Such prehardening was accomplished by raising the temperature of the gear blank in a furnace and subsequently quenching and tempering the blank at a predetermined rate and temperature. Following such initial prehardening, the uncut gear blank was machined to form a plurality of gear teeth about the circumference thereof. Lastly, the gear was subjected to a contour hardening process, typically in an inductor or coil, to provide a contour hardened gear have a sufficiently strong prehardened core. Although this process has been effective to produce contour hardened gears, it is proven to be difficult because the teeth of the gear are machined after the uncut gear blank has been prehardened, rather than when the blank is in a softened condition.

SUMMARY OF THE INVENTION

The present invention relates to an improved method for forming a contour hardened gear. Initially, an uncut gear blank is softened by a heat treatment process to provide a relatively soft level of hardness throughout. Then, the softened gear blank is machined so as to form a plurality of teeth about the circumference thereof. The relatively soft machined gear is next subjected to a prehardening process, wherein the surfaces of the teeth and the outer region of the core are hardened to a predetermined intermediate level of hardness. Finally, the prehardened gear is subjected to a contour hardening process such that the surface of the gear teeth are further significantly hardened. The outer region of the core of the gear remains at the intermediate hardness level, while the inner region of the core remains at the relatively soft level.

It is an object of the present invention to provide an improved method for forming a contour hardened gear.

It is another object of the present invention to provide such a method wherein the machining of the gear teeth occurs when the gear blank is in a relatively soft condition.

Other objects and advantages of the present invention will become apparent to those skilled in the art from the following detailed description of the preferred embodiment, when read in light of the accompanying drawings.

DETAILED DESCRIPTION OF THE PREFERRED EMBODIMENT

Figure 1:
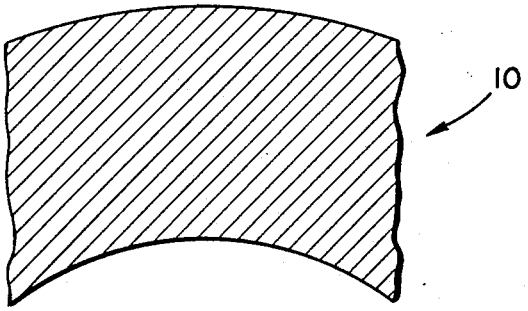
FIGS. 1 through 4 are fragmentary sectional elevational views illustrating the steps of the method for forming a contour hardened gear in accordance with the present invention.

Referring now to the drawings, there is illustrated in FIG. 1 a portion of a metallic gear blank, indicated generally at 10. The gear blank 10 may be formed from any grade of steel that provides sufficient hardenability when subjected to the process of the present invention, such as SAE 5155 steel. The gear blank 10 is generally annular in shape and may be formed by a conventional forging or blanking process. The blank 10 has the general shape of the final gear which is to be formed by the process of the present invention. Thus, the outer diameter of the gear blank 10 is only slightly larger than the outer diameter of the teeth of the gear to be formed.

The gear blank 10 is initially subjected to a softening process so as to soften the metal thereof to a desired level of hardness. The amount of the softening of the gear blank 10 is dependent upon the grade of the metal being used, but generally such softening should be sufficient to permit relatively easy machining thereof (such as gear cutting) as described below. Typically, if the gear blank is softened to approximately 98RB (Rockwell "B" hardness scale) or less, the gear blank 10 will be sufficiently soft. As a specific example, when the gear blank 10 is formed from the SAE 5155 material identified above, the initial softening process can be used to soften the gear blank 10 to approximately 89RB.

The softening of the metallic gear blank 10 can be accomplished by any conventional heat treatment process. For example, the gear blank 10 may be annealed in any known manner to soften the metal of the gear blank 10. Alternatively, the gear blank 10 may be normalized or quenched and tempered to achieve the desired level of softness. The selection of the particular method used to soften the gear blank 10 will depend upon, among other things, the grade of the metal used to form the blank 10 and the desired softness sought to be achieved.

Figure 2:
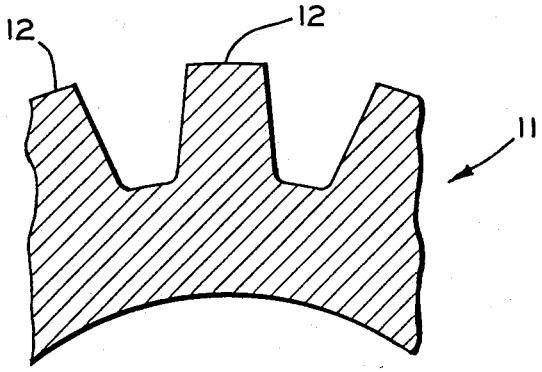

By initially softening the metal of the gear blank 10 to this level, it becomes relatively easy to perform the next step of the process, which is to form a gear, indicated generally at 11 in FIG. 2, having a plurality of gear teeth 12. The gear teeth 12 are formed by removing material from predetermined portions of the gear blank 10, and any conventional machining process may be used for accomplishing such removal. It will be appreciated that the formation of the gear teeth 12 does not change the level of hardness any portion of the gear 11. Thus, all regions of the gear 11, remain at the 89RB hardness level following the formation of the gear teeth 12.

Following the machining step, the gear 11 is subjected to a prehardening process. As will be explained in greater detail below, the prehardening step is necessary to provide the core of the gear 11 with the proper hardness and strength required for the intended use thereof. During the prehardening step, the temperature of some or all of the gear 11 is raised above the critical temperature at which the particular material used to form the gear 11 changes to austenite. The critical temperature will, of course, vary with the particular grade of material being used. This heating of the gear 11 is preferably accomplished by induction heating using any conventional apparatus, such as an inductor or coil.

Figure 3:
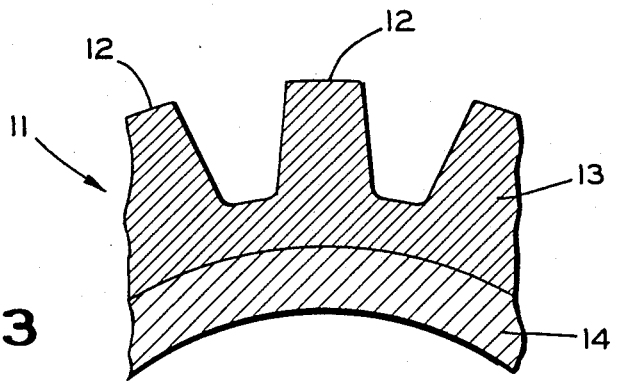
Figure 4:
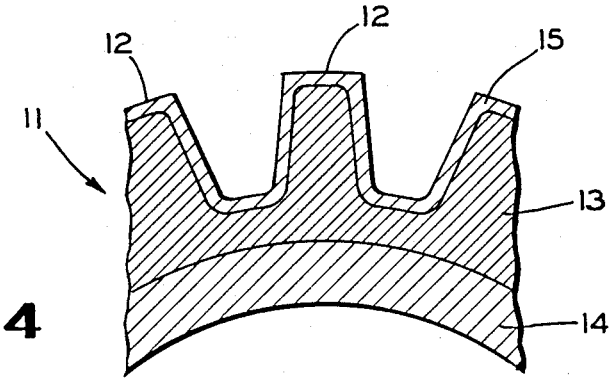

The gear 11 is heated at the critical temperature for a predetermined period of time, thereby causing the austenite transformation throughout a predetermined depth within the gear 11, illustrated as an outer annular region 13 of the core in FIGS. 3 and 4. The particular depth of the penetration is dependent upon the desired strength for the core of the gear 11 which, in turn, is dependent upon the intended use therefor. The length of time during which the gear 11 is heated and the grade of the material used to form the gear 11 determines the depth of penetration. Although such depth can vary from application to application, it is generally necessary that the outer region 13 of the core extend at least below the root line of the gear teeth 12 in order to provide the desired strength.

Having been heated above the critical temperature for the predetermined period of time, the gear 11 is then cooled at a relatively slow rate. Such rate is determined by the desired hardness for the outer region 13 of the core of the gear 11 and by the grade of the material used to form the gear 11. The slow cooling process also helps to minimize distortion of the gear 11. The cooling process can be accomplished by simply cooling the gear 11 in air, or by gas quenching the gear 11 using forced air or inert gas. Alternatively, the gear 11 may be cooled by liquid quenching, if the grade of the metal used to form the gear 11 has a relatively low level of hardenability.

After the prehardening steps described above, the gear 11 has the general structure illustrated in FIG. 3, wherein the teeth 12 and the outer annular region 13 of the core of the gear 11 thereof are significantly hardened above the initial softened condition. For example, the teeth 12 and the outer region 13 of the core of the gear 11 may be hardened to between 25RC and 45RC (Rockwell "C" hardness scale), which is a satisfactory level of hardness for general uses of the gear 11. An inner region 14 of the core of the gear 11, however, remains at the softer 89RB hardness level because the duration of the prehardening step was not long enough for the temperature of that inner region 14 to rise above the critical temperature, as described above.

The final step of the process involves hardening of the contour or case of the gear 11. The contour hardening step also involves raising the temperature of a portion of the gear 11 above the critical temperature, similar to the prehardening step discussed above. However, the duration of the heating is much shorter in the contour hardening step than in the prehardening step, so as to limit the penetration depth to the relatively thin contour of the teeth 12 of the gear 11. Following such heating, the gear 11 is rapidly cooled to yield the general structure illustrated in FIG. 4, wherein the outer contour or case 15 of the gear teeth 12 is further significantly hardened relative to the outer region 13 of the core, for example to between 52RC and 65RC. The outer region 13 of the core of the gear 11 remains at the 25RC to 45RC range, while the inner region 14 of the core of the gear 11 remains at the lesser 89RB hardness level. The contour hardening process can be accomplished by any conventional means and, for example, can be performed by the same inductor or coil which performed the prehardening step described above.

In accordance with the provisions of the patent statutes, the principle and mode of operation of the present invention have been explained and illustrated in its preferred embodiment. However, it must be understood that the present invention may be practiced otherwise than as specifically explained and illustrated without departing from its spirit or scope.

What is claimed is:

1. A method for forming a contour hardened gear comprising the steps of:

(a) providing a gear blank;

(b) softening the gear blank by a heat treatment process to provide a relatively soft level of hardness throughout;

(c) machining the softened gear blank so as to form a plurality of teeth about the circumference thereof;

(d) prehardening the machined gear blank such that surfaces of the teeth and an outer region of a core of the gear are hardened to an intermediate level of hardness while an inner region of the core remains at the relatively soft level of hardness; and (e) contour hardening the prehardened gear such that the surfaces of the gear teeth are further significantly hardened, while the outer region of the core of the gear remains at the intermediate level of hardness and the inner region of the core remains at the relatively soft level of hardness.

2. The invention defined in claim 1 wherein said heat treatment process of step (b) is performed by annealing the gear blank.

3. The invention defined in claim 1 wherein said heat treatment process of step (b) is performed by normalizing the gear blank.

4. The invention defined in claim 1 wherein said heat treatment process of step (b) is performed by heating, quenching, and tempering the gear blank.

5. The invention defined in claim 1 wherein said heat treatment process of step (b) softens the gear blank to 98 on the Rockwell "B" hardness scale or softer.

6. The invention defined in claim 1 wherein said prehardening process of step (d) extends into the outer region of the core at least below a root line defined by the gear teeth.

7. The invention defined in claim 1 wherein said prehardening process of step (d) is accomplished by induction heating.

8. The invention defined in claim 1 wherein said prehardening process of step (d) hardens the machined gear blank to between 25 and 45 on the Rockwell "C" hardness scale.

9. The invention defined in claim 1 wherein said contour hardening process of step (e) is accomplished by induction heating.

10. The invention defined in claim 1 wherein said contour hardening process of step (e) hardens the surfaces of the gear teeth machined gear blank to between 57 and 65 on the Rockwell "C" hardness scale.

* * * * *